US010543895B1

(12) United States Patent
McGinley et al.

(10) Patent No.: US 10,543,895 B1
(45) Date of Patent: Jan. 28, 2020

(54) HYDRAULIC STEERING SYSTEM FOR A WATERCRAFT

(71) Applicant: BRP US INC., Sturtevant, WI (US)

(72) Inventors: Samuel McGinley, Milwaukee, WI (US); Darrell Wiatrowski, Libertyville, IL (US); Jeremiah Gillis, Milwaukee, WI (US)

(73) Assignee: BRP US INC., Sturtevant, WI (US)

( * ) Notice: Subject to any disclaimer, the term of this patent is extended or adjusted under 35 U.S.C. 154(b) by 0 days.

(21) Appl. No.: 16/022,157

(22) Filed: Jun. 28, 2018

Related U.S. Application Data

(60) Provisional application No. 62/579,856, filed on Oct. 31, 2017.

(51) Int. Cl.

| | |
|---|---|
| ***B63H 20/12*** | (2006.01) |
| ***B63H 20/00*** | (2006.01) |
| ***B63H 25/04*** | (2006.01) |
| ***B63H 25/42*** | (2006.01) |
| *B63H 25/02* | (2006.01) |

(52) U.S. Cl.
CPC ..... *B63H 25/04* (2013.01); *B63H 20/12* (2013.01); *B63H 21/265* (2013.01); *B63H 25/42* (2013.01); *B63H 2020/003* (2013.01); *B63H 2025/022* (2013.01)

(58) Field of Classification Search
CPC ..... B63H 25/04; B63H 21/265; B63H 20/12; B63H 25/42; B63H 2025/022; B63H 2020/003
USPC ..... 440/53, 61 R, 61 S, 61 A, 61 B, 61 C
See application file for complete search history.

(56) References Cited

U.S. PATENT DOCUMENTS

| | | | | |
|---|---|---|---|---|
| 7,267,588 | B1 * | 9/2007 | Griffiths | B63H 21/265 114/172 |
| 7,311,572 | B2 * | 12/2007 | Yamashita | B63H 20/12 440/60 |
| 7,467,595 | B1 * | 12/2008 | Lanyi | B63H 21/213 114/144 R |
| 9,718,525 | B1 * | 8/2017 | Wiatrowski | B63H 20/12 |
| 9,932,098 | B1 * | 4/2018 | Andrasko | B63H 20/12 |
| 2006/0105647 | A1 * | 5/2006 | Yazaki | B63H 21/213 440/53 |
| 2011/0028057 | A1 * | 2/2011 | Torrangs | B63H 20/12 440/53 |

(Continued)

*Primary Examiner* — Anthony D Wiest
(74) *Attorney, Agent, or Firm* — BCF LLP

(57) ABSTRACT

A steering system for a watercraft has steering position sensors sensing a steering position of first and second outboard motors, hydraulic steering actuators for steering the outboard motors, a hydraulic helm selectively supplying hydraulic fluid to the steering actuators, at least one valve for reversing a direction of flow of hydraulic fluid into the steering actuators, and a steering controller. The steering controller executes a realignment process including: receiving signals indicative of the steering positions of the outboard motors from the steering position sensors; based at least in part on the signals, determining if the outboard motors are misaligned; and, if the outboard motors are misaligned, actuating the at least one valve to direct the flow of hydraulic fluid into a corresponding steering actuator in a direction opposite to that corresponding to an active steering direction set by the hydraulic helm so as to reduce misalignment of the outboard motors.

20 Claims, 7 Drawing Sheets

(56) References Cited

U.S. PATENT DOCUMENTS

2014/0106632 A1* 4/2014 Nakayasu ..... B63H 21/21
440/1

* cited by examiner

HYDRAULIC STEERING SYSTEM FOR A WATERCRAFT

CROSS-REFERENCE

The present application claims priority to U.S. Provisional Patent Application No. 62/579,856, filed on Oct. 31, 2017, the entirety of which is incorporated herein by reference.

FIELD OF TECHNOLOGY

The present technology relates to hydraulic steering systems for watercraft.

BACKGROUND

Many watercraft are propelled by multiple outdrives (e.g., two, three or more) such as outboard motors, stern drives and pod drives for example. To steer the watercraft, the outdrives are pivoted relative to the rest of the watercraft. This is often achieved by hydraulic steering actuators. To control the steering of the watercraft, the driver turns a helm. In some steering systems, turning the helm pushes hydraulic fluid in one direction to the hydraulic steering actuators which causes them to steer the outdrives. In such systems, the helm acts as a hydraulic pump and is known as a hydraulic helm.

Multiple outdrives can be linked to ensure that they remain generally aligned with one another such that steering of one outdrive is replicated by the other outdrive(s). Such a link may be mechanical, commonly known as a "tie bar", or hydraulic, known as a "liquid tie bar". However, during use, outdrives linked by a liquid tie bar may become misaligned relative to one another due to, for example, hydraulic fluid leaks in the steering system of the watercraft. In order to realign the outdrives, typically an operator of the watercraft has to manually open a valve of the steering system and push one or more of the outdrives into alignment with the other outdrives. While this can reduce misalignment of the outdrives, it is a physical, time-consuming task that, moreover, typically requires the watercraft to be out of the water while it is being realigned.

There is therefore a desire for a hydraulic steering system for a watercraft that can realign the outdrives of the watercraft automatically.

SUMMARY

It is an object of the present technology to ameliorate at least some of the inconveniences present in the prior art.

According to one aspect of the present technology, there is provided a steering system for a watercraft having first and second outboard motors. The steering system includes: a first steering position sensor for sensing a steering position of the first outboard motor; a second steering position sensor for sensing a steering position of the second outboard motor; a first hydraulic steering actuator for steering the first outboard motor; a second hydraulic steering actuator for steering the second outboard motor, the second hydraulic steering actuator being hydraulically linked to the first hydraulic steering actuator; a hydraulic helm selectively supplying hydraulic fluid to the first and second hydraulic steering actuators in accordance with an active steering direction selected by an operator of the watercraft; at least one valve for reversing a direction of flow of hydraulic fluid into the first and second hydraulic steering actuators; and a steering controller in communication with the first and second steering position sensors and the at least one valve. The steering controller is configured to execute a realignment process including: receiving signals indicative of the steering positions of the first and second outboard motors from the first and second steering position sensors; based at least in part on the signals from the first and second steering position sensors, determining if the first outboard motor and the second outboard motor are misaligned; and if the first outboard motor and the second outboard motor are determined to be misaligned, actuating the at least one valve in order to direct the flow of hydraulic fluid into a corresponding one of the first and second hydraulic steering actuators in a direction opposite to that corresponding to the active steering direction set by the hydraulic helm so as to reduce misalignment of the first and second outboard motors.

In some implementations of the present technology, the at least one valve includes a first valve and a second valve. The first valve is configured for reversing the direction of flow of hydraulic fluid into the first hydraulic steering actuator and the second valve is configured for reversing the direction of flow of hydraulic fluid into the second hydraulic steering actuator.

In some implementations of the present technology, actuating the at least one valve comprises actuating only a selected one of the first and second valves.

In some implementations of the present technology, the first outboard motor has a first thrust axis and the second outboard motor has a second thrust axis. When the first and second outboard motors are misaligned such that the first and second thrust axes converge toward one another rearwardly, actuating the selected one of the first and second valves is operable to cause the corresponding one of the first and second hydraulic steering actuators to steer a corresponding one of the first and second outboard motors such as to reduce convergence of the first and second thrust axes. When the first and second outboard motors are misaligned such that the first and second thrust axes diverge from one another rearwardly, actuating the selected one of the first and second valves is operable to cause the corresponding one of the first and second hydraulic steering actuators to steer a corresponding one of the first and second outboard motors such as to reduce divergence of the first and second thrust axes.

In some implementations of the present technology, the first outboard motor is a port outboard motor and the second outboard motor is a starboard outboard motor. The first thrust axis is a port thrust axis and the second thrust axis is a starboard thrust axis. The first valve is a port valve and the second valve is a starboard valve. The first hydraulic steering actuator is a port hydraulic steering actuator and the second hydraulic steering actuator is a starboard hydraulic steering actuator. When the hydraulic helm is being actively steered such as to change a current course of the watercraft and the active steering direction set by the hydraulic helm is starboard, the selected one of the port and starboard valves is: the port valve when the port and starboard outboard motors are misaligned such that the port and starboard thrust axes converge toward one another rearwardly, such that actuating the port valve reduces convergence of the port and starboard thrust axes; the starboard valve when the port and starboard outboard motors are misaligned such that the port and starboard thrust axes diverge from one another rearwardly, such that actuating the starboard valve reduces divergence of the port and starboard thrust axes. When the hydraulic helm is being actively steered such as to change a current course of the watercraft and the active steering direction set by the hydraulic helm is port, the selected one of the port and starboard valves is: the starboard valve when the port and starboard outboard motors are misaligned such that the port and starboard thrust axes converge toward one another rearwardly, such that actuating the starboard valve reduces convergence of the port and starboard thrust axes; the port valve when the port and starboard outboard motors are misaligned such that the port and starboard thrust axes diverge from one another rearwardly, such that actuating the port valve reduces divergence of the port and starboard thrust axes.

In some implementations of the present technology, the hydraulic helm is hydraulically connected to the first hydraulic steering actuator. The first hydraulic steering actuator is hydraulically connected to the second hydraulic steering actuator. The second hydraulic steering actuator is hydraulically connected to the hydraulic helm. The at least one valve is hydraulically connected between at least one of the first and second hydraulic steering actuators and the hydraulic helm.

In some implementations of the present technology, the steering system further includes a steering operation detector for detecting a steering parameter of the hydraulic helm. The steering controller is in communication with the steering operation detector. The realignment process includes: receiving the steering parameter of the hydraulic helm from the steering operation detector; based on the steering parameter, determining if the hydraulic helm is in an active steering state in which the hydraulic helm is being operated to actively steer the watercraft such as to change a current course of the watercraft. Said actuating of the at least one of the first and second valves is carried out only if the hydraulic helm is determined to be in the active steering state.

In some implementations of the present technology, the hydraulic helm has a first hydraulic connection to the first hydraulic steering actuator and a second hydraulic connection to the second hydraulic steering actuator. The steering parameter detected by the steering operation detector is a pressure difference between a pressure in the first hydraulic connection and a pressure in the second hydraulic connection.

In some implementations of the present technology, the steering operation detector comprises a first hydraulic pressure sensor for sensing a pressure in the first hydraulic connection and a second hydraulic pressure sensor for sensing a pressure in the second hydraulic connection.

In some implementations of the present technology, the steering controller determines that the watercraft is in the active steering state when the pressure difference is greater than a predetermined pressure difference threshold.

In some implementations of the present technology, the predetermined pressure difference threshold is less than or equal to 10 psi.

In some implementations of the present technology, the first steering position sensor senses a steering angle of the first outboard motor and the second steering position sensor senses a steering angle of the second outboard motor. The steering position of the first outboard motor is defined by the steering angle of the first outboard motor, and the steering position of the second outboard motor is defined by the steering angle of the second outboard motor. The steering controller determines that the first outboard motor and the second outboard motor are misaligned when a steering angle difference between the steering angle of the first outboard motor and the steering angle of the second outboard motor is greater than a first predetermined angle difference threshold.

In some implementations of the present technology, the first predetermined angle difference threshold is less than or equal to 9°

In some implementations of the present technology, the first predetermined angle difference threshold is less than or equal to 6°.

In some implementations of the present technology, the steering controller maintains the at least one valve open until the steering angle difference is below a second predetermined angle difference threshold that is less than the first predetermined angle difference threshold.

In some implementations of the present technology, the second predetermined angle difference threshold is less than or equal to 6°.

In some implementations of the present technology, the second predetermined angle difference threshold is 0°.

In some implementations of the present technology, the steering controller is configured to end the realignment process after a predetermined time period of having started the actuation of the at least one valve.

In some implementations of the present technology, the predetermined time period is less than 1 second.

In some implementations of the present technology, the predetermined time period is less than or equal to 0.3 seconds.

In some implementations of the present technology, after ending the realignment process, the steering controller reinitiates the realignment process when the steering controller determines that the watercraft is being steered in a direction opposite to the active steering direction selected by the operator prior to aborting the realignment process.

In some implementations of the present technology, the steering controller is configured to end the realignment process at any time that the hydraulic helm is no longer in the active steering state.

According to another aspect of the present technology, there is provided a steering system for a watercraft having a plurality of outboard motors. The steering system includes: a plurality of steering position sensors for sensing a steering position of the plurality of outboard motors; a plurality of hydraulic steering actuators for steering the plurality of outboard motors; a hydraulic helm selectively supplying hydraulic fluid to the plurality of hydraulic steering actuators in accordance with an active steering direction selected by an operator of the watercraft; a plurality of valves for reversing a direction of flow of hydraulic fluid into the plurality of hydraulic steering actuators; and a steering controller in communication with the plurality of steering position sensors and the plurality of valves. The steering controller is configured to execute a realignment process including: receiving signals indicative of the steering positions of the plurality of outboard motors from the plurality of steering position sensors; based at least in part on the signals from the plurality of steering position sensors, determining if the plurality of outboard motors are misaligned; and if the plurality of outboard motors are determined to be misaligned, actuating at least one of the plurality of valves in order to direct the flow of hydraulic fluid into a selected one of the plurality of hydraulic steering actuators in a direction opposite to that corresponding to the active steering direction set by the hydraulic helm so as to reduce misalignment of the plurality of outboard motors.

In some implementations of the present technology, each of the plurality of steering position sensors senses a steering angle of an associated one of the plurality of outboard motors. The steering positions of the plurality of outboard motors are defined by the steering angles of the plurality of outboard motors. The steering controller determines that the plurality of outboard motors are misaligned when a steering angle difference between a steering angle of a first outboard motor of the plurality of outboard motors and a steering angle of a second outboard motor of the plurality of outboard motors is greater than a predetermined angle difference threshold.

According to another aspect of the present technology, there is provided a method of aligning first and second outboard motors of a watercraft. The first and second outboard motors are hydraulically linked. The method includes: comparing a steering position of the first outboard motor to a steering position of the second outboard motor; based on said comparing, determining if the first outboard motor and the second outboard motor are misaligned; if the first outboard motor and the second outboard motor are determined to be misaligned, actuating a valve in order to direct flow of hydraulic fluid into a hydraulic steering actuator of one of the first and second outboard motors in a direction opposite to that corresponding to an active steering direction set by a hydraulic helm of the watercraft so as to reduce misalignment of the first and second outboard motors.

Explanations and/or definitions of terms provided in the present application take precedence over explanations and/or definitions of these terms that may be found in the document incorporated herein by reference.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

A hydraulic steering system for a watercraft will be described with respect to a watercraft having two outdrives. Outdrives may include, but are not limited to, outboard motors, stern drives, and pod drives. The watercraft as described below is propelled by two outboard motors, each having an internal combustion engine. It is also contemplated that the steering system could be used for different types of watercraft driven by at least two outdrives, including, but not limited to, speed boats and sport boats.

Figure 1:
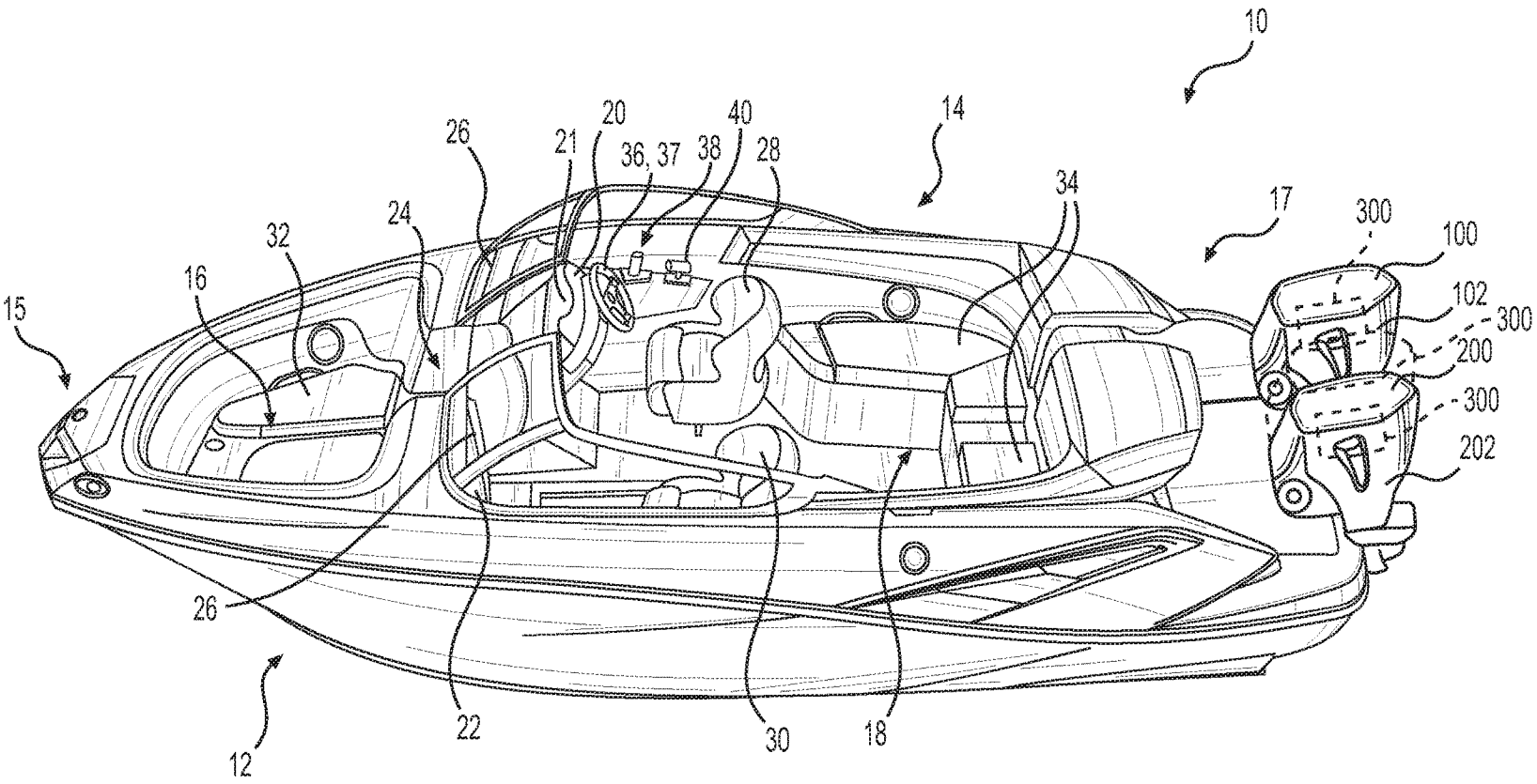
FIG. 1 is a top, left side perspective view of a watercraft.

The general construction of the watercraft 10 is illustrated in FIG. 1. It should be understood that the watercraft 10 could have a construction other than the one described below.

The watercraft 10 has a hull 12 and a deck 14 supported by the hull 12. The watercraft has a front 15 and a rear 17. The deck 14 has a forward passenger area 16 and a rearward passenger area 18. A right console 21 including a dashboard 20 and a left console 22 are disposed on either side of the deck 14 between the two passenger areas 16, 18. A passageway 24 disposed between the two consoles 21, 22 allows for communication between the two passenger areas 16, 18. Windshields 26 are provided over the consoles 21, 22.

A driver seat 28 and a passenger seat 30 are disposed behind the consoles 20 and 22 respectively. Seats 32 and 34 are also provided in the forward and rearward passenger areas 16 and 18 respectively. The dashboard 20 is provided with a hydraulic helm 36 used by an operator of the watercraft 10 to steer the watercraft 10. In the present implementation, the hydraulic helm 36 includes a steering wheel 37. As will be described in more detail below, the watercraft 10 has a steering system 50, including the hydraulic helm 36, for steering the watercraft 10. In this implementation, an auxiliary steering input device, in the form of a joystick 38, is also provided for steering the watercraft 10 under certain conditions. It is contemplated that the joystick 38 could be replaced by a knob, track pad, multiple levers or any other device allowing for multi-directional input.

The watercraft 10 has a twin motor arrangement. More specifically, the watercraft 10 includes an outboard motor 100 with an internal combustion engine 102 on a rear, starboard side of the watercraft 10 and an outboard motor 200 with an internal combustion engine 202 on a rear, port side of the watercraft 10. It is contemplated that the outboard motors 100, 200 could be equipped with different kinds of motors, including, but not limited to: electric motors and hybrid internal combustion-electric motors. The outboard motors 100, 200 are similar except that their propellers (not shown) turn in opposite directions during standard operation. The outboard motors 100, 200 are rotatably connected to the deck 14 and more specifically to a stern 23 thereof, but it is contemplated that the motors 100, 200 could be rotatably connected to the hull 12. A thrust input device in the form of a throttle lever 40 is provided to provide control of thrust created by the outboard motors 100, 200. It is contemplated that two throttle levers 40 could be provided to separately control each of the outboard motors 100, 200. It is contemplated that the throttle lever 40 could be replaced with a throttle pedal, a twist grip, a finger actuated throttle lever or any other device allowing the driver of the watercraft 10 to control the thrust generated by the outboard motors 100, 200. In an implementation described further below, the watercraft is provided with a central outboard motor 300 (shown in dotted lines in FIG. 1) disposed laterally between the outboard motors 100, 200.

The watercraft 10 includes other features not described herein, such as electrical and fuel systems. It should be understood that such features are nonetheless present in the watercraft 10.

As described above, the watercraft 10 includes the hydraulic helm 36 and the joystick 38. In the present implementation, these two steering inputs are used independently and cannot be used at the same time.

Figure 2:
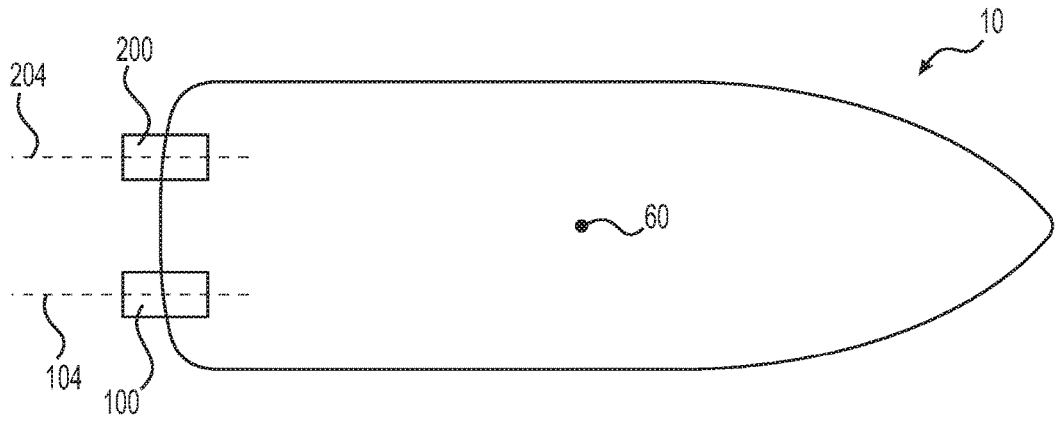
FIG. 2 is a schematic, top plan view of the watercraft of FIG. 1, with two outboard motors in a forward facing arrangement.
Figure 3:
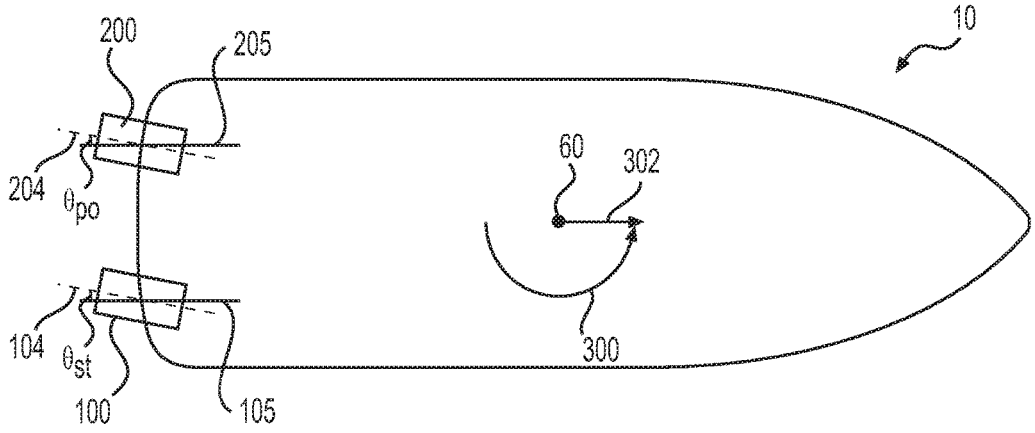
FIG. 3 is the schematic watercraft of FIG. 2, with the outboard motors steered to port.

The steering system 50 sets a steering position of each of the outboard motors 100, 200 in accordance with a steering direction (e.g., straight, port, starboard) set by the operator through the hydraulic helm 36. In this implementation, when the watercraft 10 is travelling in a straight direction (i.e., not steering toward port or starboard), the outboard motors 100, 200 are forward facing as shown in FIG. 2. In the forward facing arrangement, thrust axes 104, 204 of the outboard motors 100, 200 (defined by the respective propeller axes of the outboard motors 100, 200) are generally perpendicular to the hull 12 and parallel to a longitudinal axis of the watercraft 100, and provide generally forward motion upon thrust from the outboard motors 100, 200. When the hydraulic helm 36 is turned, the outboard motors 100, 200 turn by a same amount as one another and in a same direction together. For example, FIG. 3 illustrates a position of the outboard motors 100, 200 in response to the hydraulic helm 36 being turned port (i.e., counter-clockwise). As can be seen in FIG. 3, the combination of the forward thrusts generated by the outboard motors 100, 200 generates a forward thrust 302 and a torque 300 about a center of rotation 60 of the watercraft 10, the center of rotation 60 being a combination of the center of gravity, moment of inertia, drag and other forces which may be acting on the watercraft 10. As a result, the watercraft 10 turns port in an arcuate motion. The torque 300 is applied in the opposite direction when the hydraulic helm 36 is turned starboard (i.e., clockwise).

Figure 5:
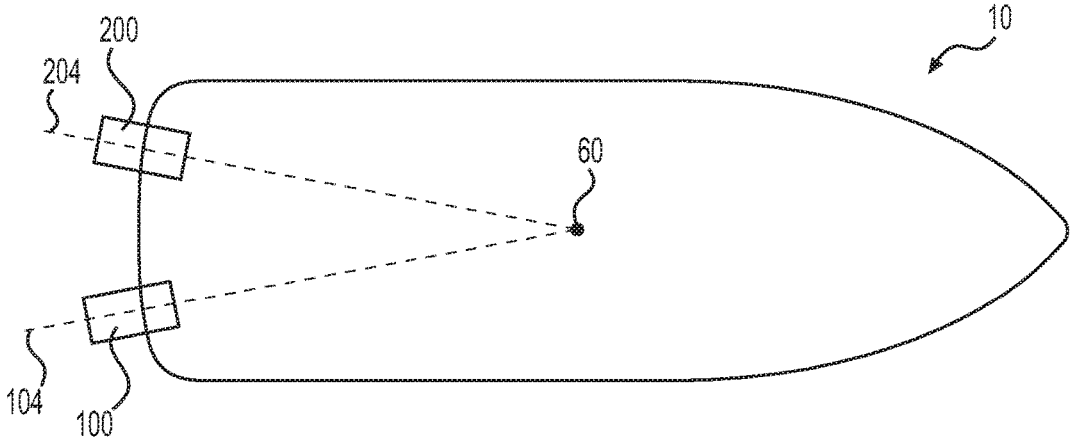
FIG. 5 is the schematic watercraft of FIG. 2, with the outboard motors in a splayed arrangement.

It is contemplated that the outboard motors 100, 200 could be in a different arrangement than the forward facing arrangement when the watercraft 10 is travelling in a straight direction. Notably, in some implementations, as shown in FIG. 5, the outboard motors 100, 200 are in a splayed arrangement so as to enable lateral translation and pivoting about the center of rotation 60 in addition to the normal forward, reverse and turns to port and starboard. In the splayed arrangement, the thrust axes 104, 204 of the outboard motors 100, 200 are angled relative to the longitudinal axis of the watercraft 10 when the watercraft 10 is travelling in a straight direction. For instance, in the implementation of FIG. 5, each of the thrust axes 104, 204 forms an acute angle with the longitudinal axis of the watercraft 100.

Figure 6:
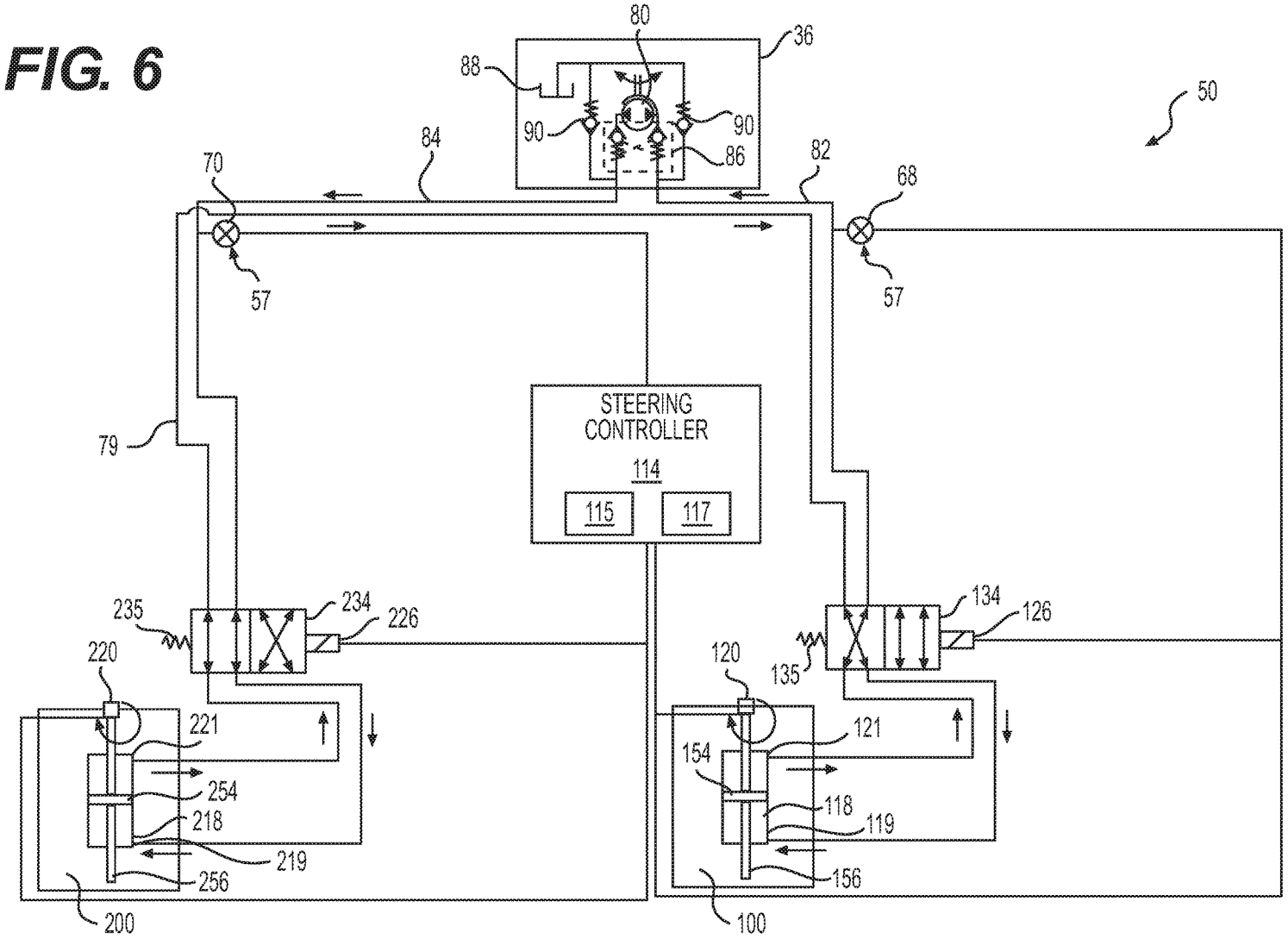
FIG. 6 is a schematic view of a hydraulic steering system of the watercraft of FIG. 1.

With reference to FIG. 6, the steering system 50 includes a steering controller 114 configured for realigning the outboard motors 100, 200 as will be described in more detail below. The steering controller 114 has a processor 115 for carrying out executable code, and a non-transitory memory module 117 that stores the executable code in a non-transitory medium (not shown) included in the memory module 117. The processor 115 includes one or more processors for performing processing operations that implement functionality of the steeling controller 114. The processor 115 may be a general-purpose processor or may be a specific-purpose processor comprising one or more preprogrammed hardware or firmware elements (e.g., application-specific integrated circuits (ASICs), electrically erasable programmable read-only memories (EEPROMs), etc.) or other related elements. The non-transitory medium of the memory module 117 may be a semiconductor memory (e.g., read-only memory (ROM) and/or random-access memory (RAM)), a magnetic storage medium, an optical storage medium, and/or any other suitable type of memory. While the steering controller 114 is represented as being one entity in this implementation, it is understood that the steering controller 114 could comprise separate entities for controlling components separately.

In some implementations, notably if the watercraft 10 is equipped with a power steering system, the steering controller 114 may be part of a larger control unit that is configured to manage the steering of the outboard motors 100, 200. Also, in some implementations, the operation of the joystick 38 may be managed by such a larger control unit integrating the steering controller 114 therein.

The steering system 50 also includes steering position sensors 120, 220 for sensing steering positions of the outboard motors 100, 200 respectively. To that end, in this implementation, the steering position sensors 120, 220 are mounted to hydraulic steering actuators 118, 218 which are hydraulically linked to one another (i.e., hydraulic fluid flows from the steering actuator 118 to the steering actuator 218) by a hydraulic line 79 commonly referred to as a "liquid tie bar". The hydraulic steering actuators 118, 218 are configured for respectively steering the outboard motors 100, 200. More specifically, the hydraulic helm 36 selectively supplies hydraulic pressure to one of two fluid inlets 119, 121, 219, 221 of each of the hydraulic steering actuators 118, 218 in accordance with the steering direction selected by the operator of the watercraft 10 which causes the steering actuators 118, 218 to steer the outboard motors 100, 200 accordingly. The steering position sensors 120, 220 sense a position of the steering actuators 118, 218 and send signals indicative of these positions to the steering controller 114. It is contemplated that the steering actuator position sensor 120 could be replaced by another sensor that can determine the steering position of the outboard motor 100. In the present implementation, the hydraulic steering actuators 118, 218 are rotary hydraulic actuators, but other hydraulic actuators such as linear actuators are contemplated. U.S. Pat. No. 7,736,206 B1, issued Jun. 15, 2010, the entirety of which is incorporated herein by reference, provides additional details regarding hydraulic steering actuators similar in construction to the hydraulic steering actuators 118, 218.

The steering wheel 37 (FIG. 1) of the hydraulic helm 36 is connected to an input pump 80 (FIG. 6). The input pump 80 operates in response to rotation of the steering wheel 37. Depending on a direction of rotation of the steering wheel 37, hydraulic fluid is pushed out of the hydraulic helm 36 via a hydraulic line 82 toward the hydraulic steering actuator 118 or via a hydraulic line 84 toward the hydraulic steering actuator 218. A locking valve 86 connected between the input pump 80 and the lines 82, 84 fluidly communicates the input pump 80 with both lines 82, 84 when the input pump 80 is operating (i.e., the steering wheel 37 is turned). The locking valve 86 prevents the flow of hydraulic fluid back toward the input pump 80 via the lines 82, 84 when the input pump 80 is not operating (i.e., the steering wheel 37 is stationary). The input pump 80 is hydraulically connected to a hydraulic fluid reservoir 88. High pressure blow-off valves 90 are connected between the lines 82, 84 and the reservoir 88 to return hydraulic fluid to the reservoir 88 from the lines 82, 84 should the hydraulic pressure in the lines become too high.

The steering system 50 further includes direction valves 134, 234 which are hydraulically connected to the steering actuators 118, 218 such that hydraulic fluid flowing towards and away from the steering actuator 118 passes through the direction valve 134 and hydraulic fluid flowing towards and away from the steering actuator 218 passes through the direction valve 234. More specifically, the direction valve 134 controls the direction of the flow of hydraulic fluid towards and away from the hydraulic steering actuator 118, thereby determining the steering direction of the outboard motor 100. Similarly, the direction valve 234 controls the direction of the flow of hydraulic fluid towards and away from the hydraulic steering actuator 218, thereby determining the steering direction of the outboard motor 200. The steering controller 114 controls the direction valve 134 via a direction valve actuator 126 which controls a position of the direction valve 134 based on a signal received from the steering controller 114. Similarly, the steering controller 114 controls the direction valve 234 via a direction valve actuator 226 which controls a position of the direction valve 234 based on a signal received from the steering controller 114. In the present implementation, the direction valve actuators 126, 226 are solenoids operating at a voltage of 12 volts, but other types of actuators are contemplated. Springs 135, 235 bias the direction valves 134, 234 respectively toward their default positions.

FIG. 6 illustrates the flow of hydraulic fluid when making a port turn. That is, the hydraulic helm 36 is turned port by the operator. This causes the pump 80 of the hydraulic helm 36 to pump hydraulic fluid through the hydraulic line 84, through the direction valve 234 and into the first fluid inlet 219 of the hydraulic steering actuator 218 below a piston 254. This causes the piston 254 to move up and the motor 200 to steer to make a port turn. As a result, fluid above the piston 254 is pushed out of the second fluid inlet 221 of the actuator 218, through the direction valve 234, through the hydraulic line 79 to the direction valve 134 and into the first fluid inlet 119 of the hydraulic steering actuator 118 below a piston 154. This causes the piston 154 to move up and the motor 100 to steer to make a port turn. As a result, fluid above the piston 154 is pushed out of the second fluid inlet 121 of the steering actuator 118, through the direction valve 134 and returns to the hydraulic helm 36.

As shown in FIG. 3, the steering position of the starboard outboard motor 100 is defined by a steering angle $\theta_{st}$ formed between the thrust axis 104 and a neutral reference axis 105 that corresponds to the position of the thrust axis 104 when the watercraft 10 is set to drive in a straight line. In other words, the steering angle $\theta_{st}$ is equal to zero when the thrust axis 104 and the neutral reference axis 105 are coaxial. In this implementation, the reference axis 105 extends along the longitudinal direction of the watercraft 10. Similarly, as shown in FIG. 3, the steering position of the port outboard motor 200 is defined by a steering angle $\theta_{po}$ formed between the thrust axis 204 and a neutral reference axis 205 that corresponds to the position of the thrust axis 204 when the watercraft 10 is set to drive in a straight line. In other words, the steering angle $\theta_{po}$ is equal to zero when the thrust axis 204 and the neutral reference axis 205 are coaxial. In this implementation, the reference axis 205 extends along the longitudinal direction of the watercraft 10.

Figure 4:
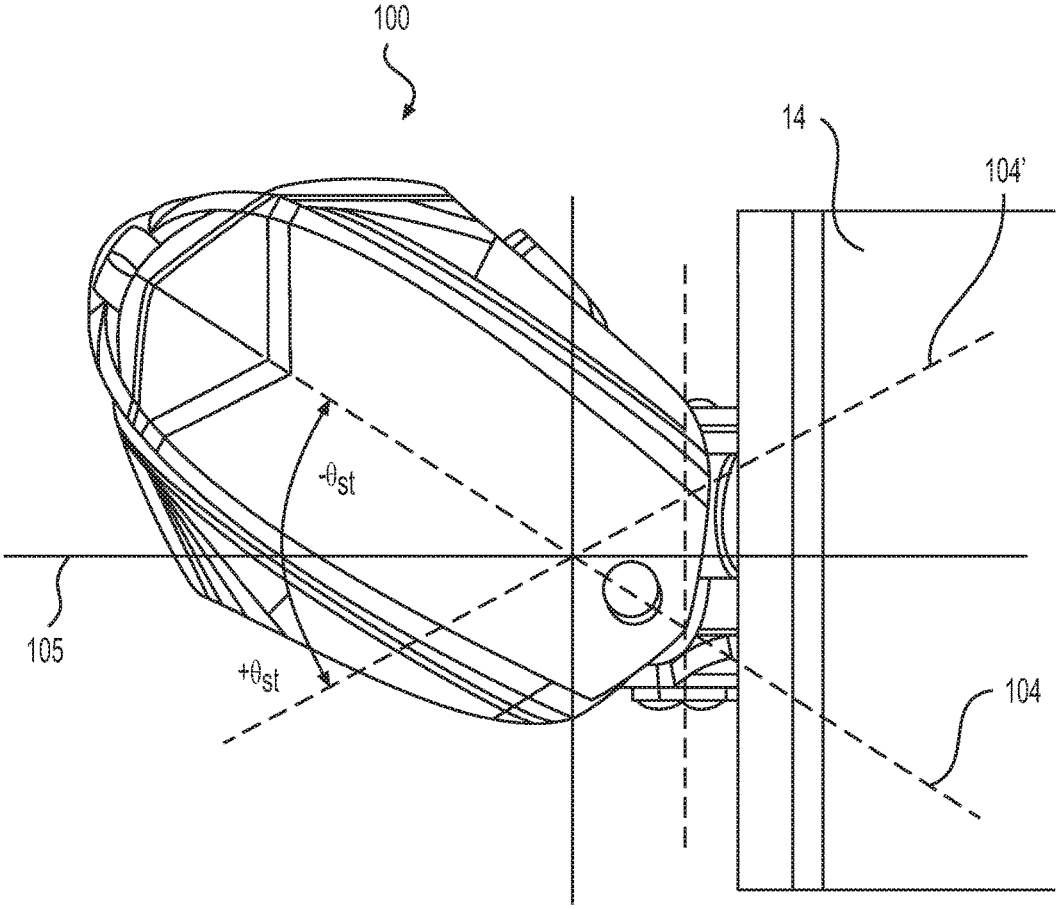
FIG. 4 is a top plan view of one of the outboard motors being steered to port.

With reference to FIG. 4, which shows the outboard motor 100, the steering angle $\theta_{st}$ is negative when the thrust axis 104 extends, at the front of the outboard motor 100, in the starboard direction relative to the neutral axis 105 (i.e., the outboard motor 100 steers to port as shown). Conversely, the angle $\theta_{st}$ is positive when the thrust axis 104 extends, at the front of the outboard motor 100, in the port direction relative to the neutral axis 105 (i.e., the outboard motor 100 steers starboard). Similarly, the steering angle $\theta_{po}$ of the outboard motor 200 is negative when the thrust axis 204 extends, at the front of the outboard motor 200, in the starboard direction relative to the neutral axis 205 (i.e., the outboard motor 200 steers port) and is positive when the thrust axis 204 extends, at the front of the outboard motor 200, in the port direction relative to the neutral axis 205 (i.e., the outboard motor 200 steers starboard). The above describes a frame of reference used herein. It is contemplated that in other frames of reference, the positive and negative values of the steering angles may be reversed. It is also contemplated that in other implementations, the frame of reference may use lines other than the neutral axes 105, 205 as the reference lines.

The outboard motors 100, 200 are hydraulically linked and initially positioned such that the outboard motors 100, 200 are aligned with one another during operation of the watercraft 10, i.e., the steering angles $\theta_{st}$, $\theta_{po}$ are the same as the outboard motors 100, 200 are steered. However, as explained above, with use, the outboard motors 100, 200 may gradually become misaligned with respect to one another due to, for example, leaks in the hydraulic connections of the steering system 50. As will be described in more detail below, the steering system 50 is configured to automatically realign the outboard motors 100, 200 without intervention from the operator of the watercraft 10. More specifically, the steering controller 114 is configured to execute a realignment process for verifying the alignment of the outboard motors 100, 200 relative to one another and, if necessary, realign the outboard motors 100, 200.

Figure 7:
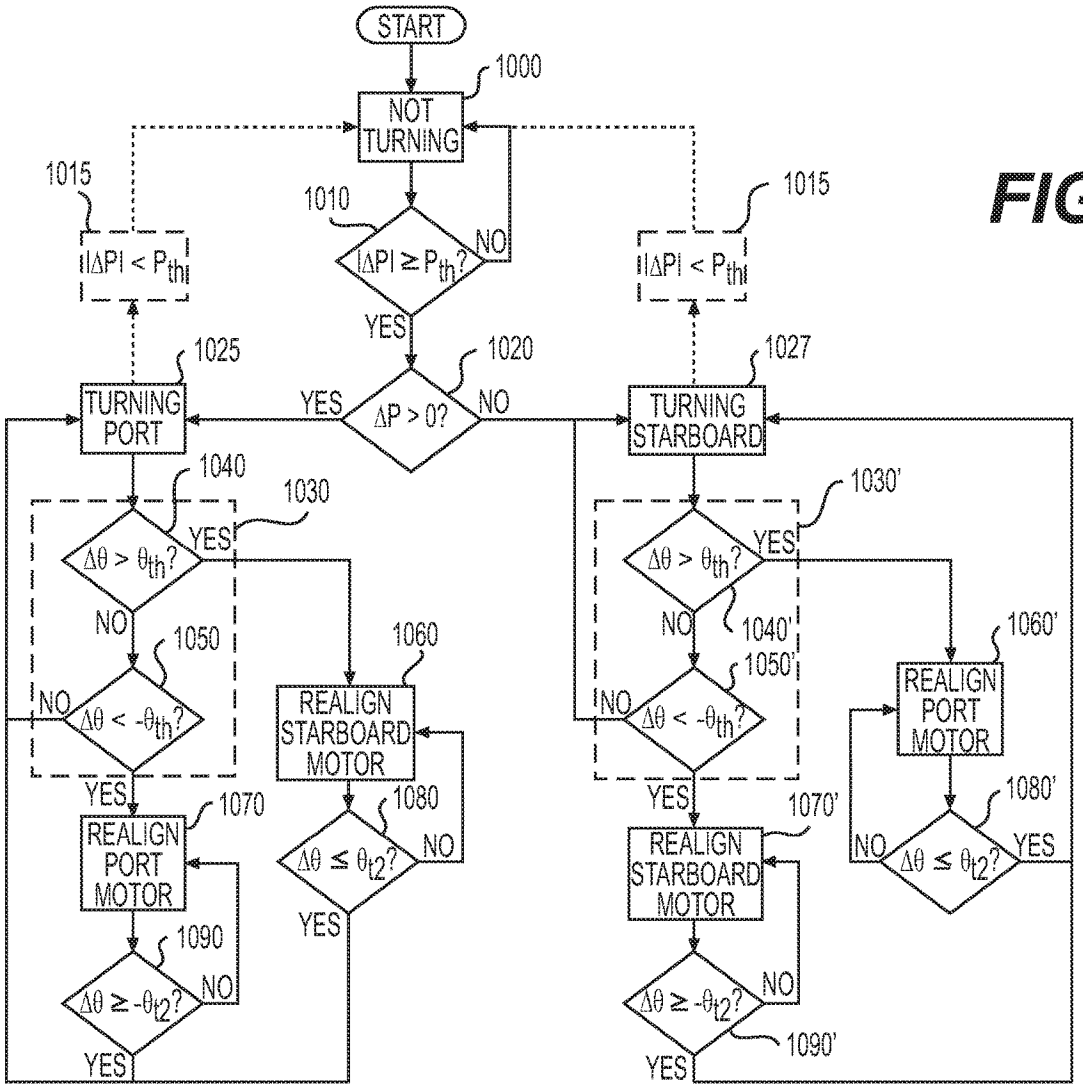
FIG. 7 is a logical diagram of a realignment process executed by a steering controller of the hydraulic steering system of FIG. 6.

With reference to FIG. 7, the realignment process of the steering controller 114 begins, at step 1000, with determining that the hydraulic helm 36 is not being operated to change a current course of the watercraft 10 (i.e., that the steering position of the outboard motors 100, 200 is not changing). The process continues, at step 1010, with determining if the hydraulic helm 36 is now in an "active steering state" in which the hydraulic helm 36 is being operated to actively steer the watercraft 10 (i.e., that the steering position of the outboard motors 100, 200 is changing) in an active steering direction such as to change the current course of the watercraft 10. In other words, the hydraulic helm 36 is in the active steering state when the operator is changing the course of the watercraft 10 from its current course (i.e., as opposed to maintaining the same straight, port or starboard steering direction). It is understood that the active steering direction set by the hydraulic helm 36 is the direction towards which the course of the watercraft 10 is changing. For example, the watercraft 10 can be headed toward port but the active steering direction set by the hydraulic helm 36 is starboard if the course of the watercraft 10 is changing toward starboard.

In order to determine if the hydraulic helm 36 is in the active steering state, the steering controller 114 is in communication with a steering operation detector 57 configured to detect a steering parameter of the hydraulic helm 36. The steering parameter detected by the steering operation detector 57 is indicative of the active steering state and the steering direction of the hydraulic helm 36. The steering controller 114 thus receives the steering parameter from the steering operation detector 57 and, based on the steering parameter, determines if the hydraulic helm 36 is in the active steering state. More specifically, in this implementation, the steering operation detector 57 includes a starboard helm pressure sensor 68 and a port helm pressure sensor 70 and the steering parameter received from the steering operation detector 57 is a pressure recorded by the starboard and port helm pressure sensors 68, 70 respectively. In particular, the starboard helm pressure sensor 68 is operatively connected to the hydraulic line 82 that runs from the hydraulic helm 36 toward the outboard motor 100. The starboard helm pressure sensor 68 records a starboard hydraulic helm pressure $P_{st}$ sensed in the hydraulic line 82. The port helm pressure 70 is operatively connected to the hydraulic line 84 that runs from the hydraulic helm 36 toward the outboard motor 200. The port helm pressure sensor 70 records a port hydraulic helm pressure $P_{po}$ sensed in the hydraulic line 84. Thus, in this implementation, the steering parameter received from the steering operation detector 57 is the pressures $P_{st}$, $P_{po}$ received from the pressure sensors 68, 70. The steering controller 114 compares the pressures $P_{st}$, $P_{po}$ recorded by the starboard helm pressure sensor 68 and the port helm pressure sensor 70 and calculates a pressure difference ΔP between the port hydraulic helm pressure $P_{po}$ and the starboard hydraulic helm pressure $P_{st}$ such that $\Delta P=P_{po}-P_{st}$. As such, a positive ΔP indicates that the outboards motors 100, 200 are being actively steered to port, while a negative ΔP indicates that the outboards motors 100, 200 are being actively steered to starboard.

It is noted that, in some implementations, the pressure sensors 68, 70, the valves 134, 234, the steering position sensors 120, 220 and the steering controller 114 may be part of a power steering system of the watercraft 10, or part of the joystick steering system of the watercraft 10.

In theory, if the pressure difference ΔP is null (i.e., ΔP=0), then the hydraulic helm 36 is not in an active steering state. That is, the operator is not operating the hydraulic helm 36 to change the current course of the watercraft 10. However, in practice, the pressure difference ΔP may deviate from 0 to a certain degree even when the hydraulic helm 36 is not in the active steering state. Thus, the steering controller 114 compares the absolute value of the pressure difference ΔP (i.e., |ΔP|) with a predetermined pressure difference threshold $P_{th}$. If the absolute value of the pressure difference |ΔP| is greater than or equal to the predetermined pressure difference threshold $P_{th}$ (i.e., $|\Delta P|\geq P_{th}$), then the steering controller 114 determines that the hydraulic helm 36 is in the active steering state. If not (i.e., $|\Delta P|<P_{th}$), the steering controller 114 determines that the hydraulic helm 36 is not in the active steering state and ends the realignment process.

In this implementation, the predetermined pressure difference threshold $P_{th}$ is equal to 10 psi. However, in other implementations, the predetermined pressure difference threshold $P_{th}$ may be less than or equal to 20 psi, less than or equal to 15 psi, and even less than 10 psi. The predetermined pressure difference threshold $P_{th}$ may have any other suitable value in other implementations.

It is contemplated that, in alternative implementations, the steering controller 114 could determine if the hydraulic helm 36 is in the active steering state in other ways.

Once the steering controller 114 has determined that the hydraulic helm 36 is in the active steering state (i.e., $|\Delta P|\geq P_{th}$), at step 1020, the steering controller 114 determines if the hydraulic helm 36 is actively steering the watercraft 10 toward port or starboard. To that end, the steering controller 114 verifies if the pressure difference ΔP is greater than 0 (i.e., is positive) or less than 0 (i.e., is negative). As mentioned above, if the pressure difference ΔP is positive (i.e., ΔP>0), then the steering controller 114 determines that the hydraulic helm 36 is actively steering the watercraft 10 toward port and moves to step 1025. If, on the other hand, the pressure difference ΔP is negative (i.e., ΔP<0), then the steering controller 114 determines that the hydraulic helm 36 is actively steering the watercraft 10 toward starboard and moves to step 1027. It should be understood that at this step the steering controller 114 is not determining the direction in which the watercraft 10 is being steered by the outboard motors 100, 200, but rather determines the direction of rotation of the hydraulic helm 36. For example, the watercraft 10 could be turning port at a first steering radius, the driver could then turn the hydraulic helm 36 toward starboard so as to turn the outboard motors 100, 200 toward starboard but only to increase the steering radius of the watercraft 10 which continues to turn port. In such an example, the steering controller 114 would determine that the hydraulic helm 36 is actively steering the watercraft 10 toward starboard even though the watercraft 10 is still turning port. Alternatively, the steering controller 114 could evaluate one or both of the steering angles $\theta_{st}$, $\theta_{po}$ in order to determine if the watercraft 10 is being steered toward port or starboard. Notably, the steering controller 114 could determine the rate of change of one or both of the steering angles $\theta_{st}$, $\theta_{po}$ and determine, based on the rate of change, if the watercraft 10 is being steered toward port or starboard. For example, if the rate of change of one or both of the steering angles $\theta_{st}$, $\theta_{po}$ is positive, the steering controller 114 would determine that the watercraft 10 is turning toward starboard, whereas if the rate of change of the steering angles $\theta_{st}$, $\theta_{po}$ is negative, the steering controller 114 would determine that the watercraft 10 is turning toward port.

Next, the steering controller 114 receives signals from the steering position sensors 120, 220 indicative of the steering angles $\theta_{st}$, $\theta_{po}$ of the outboard motors 100, 200. Based at least in part on the steering positions of the outboard motors 100, 200 received from the steering position sensors 120, 220, the steering controller 114 then determines if the outboard motors 100, 200 are misaligned with respect to one another. In order to do this, the steering controller 114 calculates a steering angle difference Δθ between the steering angles $\theta_{po}$, $\theta_{st}$ of the outboard motors 100, 200 such that $\Delta\theta=\theta_{po}-\theta_{st}$.

If the steering controller 114 determines that the hydraulic helm 36 is actively steering the watercraft 10 toward port (step 1025), the process proceeds to step 1030 where, based on the steering angle difference Δθ, the steering controller 114 determines if the outboard motors 100, 200 are misaligned with respect to one another. More particularly, the steering controller 114 compares the steering angle difference Δθ with a predetermined steering angle difference threshold $\theta_{th}$ which is representative of a maximum deviation that the steering angles $\theta_{st}$, $\theta_{po}$ should have relative to one another. Specifically, at step 1040, the steering controller 114 determines if the steering angle difference Δθ is greater than the predetermined steering angle difference threshold $\theta_{th}$. If so, the steering controller 114 realigns the starboard outboard motor 100 at step 1060. On the other hand, if the steering controller 114 determines that the steering angle difference Δθ is not greater than the predetermined steering angle difference threshold $\theta_{th}$, the process continues at step 1050 where the steering controller 114 determines if the steering angle difference Δθ is less than the additive inverse of the predetermined steering angle difference threshold $\theta_{th}$ (i.e., $\Delta\theta<-\theta_{th}$). If so, the steering controller 114 realigns the port outboard motor 200 at step 1070. If, at step 1050, the steering controller 114 determines that the steering angle difference Δθ is not less than the additive inverse of the predetermined steering angle difference threshold $\theta_{th}$, then the process returns to step 1025. In this implementation, the predetermined steering angle difference threshold $\theta_{th}$ is equal to 6°. However, it is contemplated that, in alternative implementations, the predetermined steering angle difference threshold $\theta_{th}$ could be equal to or less than 10°, more than 10° or even less than 6°.

More generally, the outboard motors 100, 200 can be misaligned such that their respective thrust axes 104, 204 converge toward one another rearwardly (i.e., toward a rear of the watercraft 10) or diverge from one another rearwardly. Whether the thrust axes 104, 204 converge toward one another or diverge from one another rearwardly is dependent on the steering angles $\theta_{st}$, $\theta_{po}$. In particular, if the steering angle difference $\Delta\theta$ is greater than 0 (i.e., the steering angle difference $\Delta\theta$ is positive), the thrust axes 104, 204 converge toward one another rearwardly. If however, the steering angle difference $\Delta\theta$ is less than 0 (i.e., the steering angle difference $\Delta\theta$ is negative), the thrust axes 104, 204 diverge from one another rearwardly. It is understood that the thrust axes 104, 204 can converge towards one another rearwardly or diverge from one another rearwardly without being misaligned (i.e., while being aligned) if the degree of misalignment of the thrust axes 104, 204 is within the range permissible by the steering angle difference threshold $\theta_{th}$.

The selection of which of the direction valves 134, 234 is actuated to realign the outboard motors 100, 200 (i.e., whether to proceed to step 1060 to realign the starboard outboard motor 100 or to step 1070 to realign the port outboard motor 200) depends on the rearward convergence or divergence of the thrust axes 104, 204 and in which direction the watercraft 10 is being actively steered (i.e., port or starboard) to change the course of the watercraft 10 in accordance with the steering direction set by the hydraulic helm 36.

When the hydraulic helm 36 is being actively steered toward port (as determined at step 1025) and that the outboard motors 100, 200 are misaligned such that the thrust axes 104, 204 converge toward one another rearwardly (i.e., $\Delta\theta$ is positive), the steering controller 114 actuates the starboard direction valve 134 such as to reduce convergence of the thrust axes 104, 204 of the outboard motors 100, 200. On the other hand, when the hydraulic helm 36 is being actively steered toward port and that the outboard motors 100, 200 are misaligned such that the thrust axes 104, 204 diverge from one another rearwardly (i.e., $\Delta\theta$ is negative), the steering controller 114 actuates the port direction valve 234 such as to reduce divergence of the thrust axes 104, 204 of the outboard motors 100, 200.

At step 1060, realigning the starboard outboard motor 100 includes actuating the direction valve 134 to reverse the flow of hydraulic fluid in and out of the hydraulic steering actuator 118. That is, in order to reduce misalignment of the outboard motors 100, 200, the direction valve 134 is actuated such as to change the position thereof, thus causing the flow of hydraulic fluid into the hydraulic steering actuator 118 to be redirected into the hydraulic steering actuator 118 in a direction opposite to a direction corresponding to the active steering direction set by the hydraulic helm 36 such that the flow of hydraulic fluid in and out of the hydraulic steering actuator 118 is reversed. For instance, in the example illustrated in FIG. 6, this involves turning the outboard motor 100 toward starboard while actively steering toward port. Notably, hydraulic fluid is made to enter the hydraulic steering actuator 118 via the second fluid inlet 121 above the piston 154 of the hydraulic steering actuator 118, causing the piston 154 to move down and turn a shaft 156 of the hydraulic steering actuator 118, thereby steering the outboard motor 100 in a starboard direction. As the piston 154 moves down, hydraulic fluid below the piston 154 is pushed out of first fluid inlet 119 of the hydraulic steering actuator 118. As the outboard motor 100 is turned toward starboard, the outboard motor 200 is turned toward port (i.e. in the direction in which the hydraulic helm is being steered).

At step 1080, the steering controller 114 determines if, after beginning actuation of the direction valve 134, the steering angle difference $\Delta\theta$ is equal to or less than another predetermined steering angle difference threshold $\theta_{t2}$. If so, the outboard motors 100, 200 are within acceptable limits of misalignment and the realignment process ends and returns to step 1025. In other words, the steering controller 114 maintains the direction valve 134 open until the steering angle difference $\Delta\theta$ is equal to the predetermined steering angle threshold $\theta_{t2}$. In this implementation, the predetermined steering angle threshold $\theta_{t2}$ is equal to 0°. However, in alternative implementations, the predetermined steering angle threshold $\theta_{t2}$ may be less than or equal to the predetermined steering angle difference threshold $\theta_{th}$, which in the present implementation would be less than or equal to 6°.

Returning to step 1070, realigning the port outboard motor 200 includes actuating the direction valve 234 to reverse the flow of hydraulic fluid in and out of the hydraulic steering actuator 218. That is, in order to reduce misalignment of the outboard motors 100, 200, the direction valve 234 is actuated such as to change the position thereof, thus causing the flow of hydraulic fluid into the hydraulic steering actuator 218 to be redirected into the hydraulic steering actuator 218 in a direction opposite the active steering direction set by the hydraulic helm 36 such that the flow of hydraulic fluid in and out of the hydraulic steering actuator 118 is reversed. For example, in the example illustrated in FIG. 6, this involves turning the outboard motor 200 toward starboard while actively steering toward port. Notably, hydraulic fluid is made to enter the hydraulic steering actuator 218 via the second fluid inlet 221 above the piston 254 of the hydraulic steering actuator 218, causing the piston 254 to move down and turn a shaft 256 of the hydraulic steering actuator 218, thereby steering the outboard motor 200 in a left direction. As the piston 254 moves down, hydraulic fluid below the piston 254 is pushed out of the first fluid inlet 219 of the hydraulic steering actuator 218. As the outboard motor 200 is turned toward starboard, the outboard motor 100 is turned toward port (i.e., in the direction in which the hydraulic helm 36 is being steered).

At step 1090, the steering controller 114 determines if, after beginning actuation of the direction valve 234, the steering angle difference $\Delta\theta$ is greater than or equal to the additive inverse of the predetermined steering angle difference threshold $\theta_{t2}$ (i.e., $\Delta\theta \geq -\theta_{t2}$). If so, the outboard motors 100, 200 are within acceptable limits of misalignment and the realignment process ends and returns to step 1025. In other words, the steering controller 114 maintains the chosen one of the direction valves 134, 234 open until the steering angle difference $\Delta\theta$ is equal to the predetermined steering angle threshold $\theta_{t2}$.

Returning now to step 1020, if the steering controller 114 determines that the hydraulic helm 36 is actively steering the watercraft 10 to starboard (step 1027), the realignment process proceeds to step 1030' which is identical to step 1030 described above, including steps 1040' and 1050' which are also analogous to steps 1040 and 1050. Notably, at step 1030', based on the steering angle difference $\Delta\theta$, the steering controller 114 determines if the outboard motors 100, 200 are misaligned with respect to one another. More particularly, the steering controller 114 compares the steering angle difference $\Delta\theta$ with a predetermined steering angle difference threshold $\theta_{th}$ which is representative of the maximum deviation that the steering angles $\theta_{st}$, $\theta_{po}$ should have relative to one another.

Specifically, at step 1040', the steering controller 114 determines if the steering angle difference $\Delta\theta$ is greater than the predetermined steering angle difference threshold $\theta_{th}$. If so, the steering controller 114 realigns the port outboard motor 200 at step 1060'. On the other hand, if the steering controller 114 determines that the steering angle difference $\Delta\theta$ is not greater than the predetermined steering angle difference threshold $\theta_{th}$, the process continues at step 1050' where the steering controller 114 determines if the steering angle difference $\Delta\theta$ is less than the additive inverse of the predetermined steering angle difference threshold $\theta_{th}$ (i.e., $\Delta\theta<-\theta_{th}$). If so, the steering controller 114 realigns the starboard outboard motor 100 at step 1070'. If, at step 1050', the steering controller 114 determines that the steering angle difference $\Delta\theta$ is not less than the additive inverse of the predetermined steering angle difference threshold $\theta_{th}$, then the process returns to step 1027.

The selection of which of the direction valves 134, 234 is actuated to realign the outboard motors 100, 200 (i.e., whether to proceed to step 1060' to realign the starboard outboard motor 100 or to step 1070' to realign the port outboard motor 200) depends on the rearward convergence or divergence of the thrust axes 104, 204 and in which direction the watercraft 10 is being actively steered (i.e., port or starboard) to change the course of the watercraft 10 in accordance with the steering direction set by the hydraulic helm 36.

When the hydraulic helm 36 is being actively steered such that the steering direction set by the helm 36 is starboard (as determined at step 1027), and that the outboard motors 100, 200 are misaligned such that the thrust axes 104, 204 converge toward one another rearwardly, the steering controller 114 actuates the direction valve 234 such as to reduce convergence of the thrust axes 104, 204 of the outboard motors 100, 200. On the other hand, when the hydraulic helm 36 is being actively steered such that the steering direction set by the helm 36 is starboard, and that the outboard motors 100, 200 are misaligned such that the thrust axes 104, 204 diverge from one another rearwardly, the steering controller 114 actuates the direction valve 134 such as to reduce divergence of the thrust axes 104, 204 of the outboard motors 100, 200.

The manner in which the outboard motors 100, 200 are realigned at steps 1060', 1070' is similar to that described above with respect to steps 1060, 1070 and will therefore not be described here again.

At step 1080', the steering controller 114 determines if, after beginning actuation of the direction valve 234, the steering angle difference $\Delta\theta$ is equal to or less than the predetermined steering angle difference threshold $\theta_{t2}$. If so, the outboard motors 100, 200 are within acceptable limits of misalignment and the realignment process ends or returns to step 1027. In other words, the steering controller 114 maintains the direction valve 234 open until the steering angle difference $\Delta\theta$ is equal to the predetermined steering angle threshold $\theta_{t2}$.

At step 1090', the steering controller 114 determines if, after beginning actuation of the direction valve 134, the steering angle difference $\Delta\theta$ is greater than or equal to the additive inverse of the predetermined steering angle difference threshold $\theta_{t2}$ (i.e., $\Delta\theta\geq-\theta_{t2}$). If so, the outboard motors 100, 200 are within acceptable limits of misalignment and the realignment process ends or returns to step 1027. In other words, the steering controller 114 maintains the chosen one of the direction valves 134, 234 open until the steering angle difference $\Delta\theta$ is equal to the predetermined steering angle threshold $\theta_{t2}$.

In this implementation, the actuation of the direction valves 134, 234 is momentary and lasts for a short period of time. This may help in making the realignment of the outboard motors 100, 200 less noticeable to the operator of the watercraft 100. To that end, the steering controller 114 is configured to end the realignment process after a predetermined time period T which is measured from the moment the steering controller 114 actuates one of the direction valves 134, 234 to cause the realignment. For instance, in this implementation, the predetermined time period T is equal to 0.3 seconds. That is, after 0.3 seconds, the steering controller 114 ends the realignment process. Notably, ending the realignment process involves returning the actuated one of the direction valves 134, 234 to its original position corresponding to the active steering direction set by the hydraulic helm 36. It is contemplated that the predetermined time period T may be greater or smaller in other implementations. For instance, in some implementations, the predetermined time period T may be less than 1 second, and in some cases even less than 0.3 seconds. Alternatively, the steering controller 114 may not implement a limit on the amount of time it takes to realign the outboard motors 100, 200.

Furthermore, in this implementation, the steering controller 114 ends the realignment process at any time that the hydraulic helm 36 is no longer in the active steering state. Notably, if the pressure difference $\Delta P$ drops to less than the predetermined pressure difference threshold $P_{th}$, the steering controller 114 ends the realignment process. This is illustrated as step 1015 in FIG. 7, and can be a condition that is continuously verified throughout the realignment process (e.g., is an ongoing operation in the background that is occurring during the entire realignment process or a step that occurs between before and/or after one or more of the steps of the realignment process).

Moreover, in this implementation, after ending the realignment process, the steering controller 114 only reinitiates the realignment process when the steering controller 114 determines that the watercraft 10 is being steered in a direction opposite to the steering direction selected by the operator prior to ending the realignment process. That is, the realignment process is reinitiated only once the hydraulic helm 36 is steered by the operator in the opposite direction that the operator was steering the hydraulic helm 36 before the steering controller 114 ended the realignment process. For example, if prior to ending the realignment process, the hydraulic helm 36 was being actively steered to starboard, the realignment is reinitiated only when the steering controller 114 determines that the hydraulic helm 36 is being actively steered to port (i.e., opposite to starboard). To put it differently, if prior to ending the realignment process, the pressure difference $\Delta P$ was positive, the realignment process is reinitiated only when the pressure difference $\Delta P$ is negative.

Figure 8:
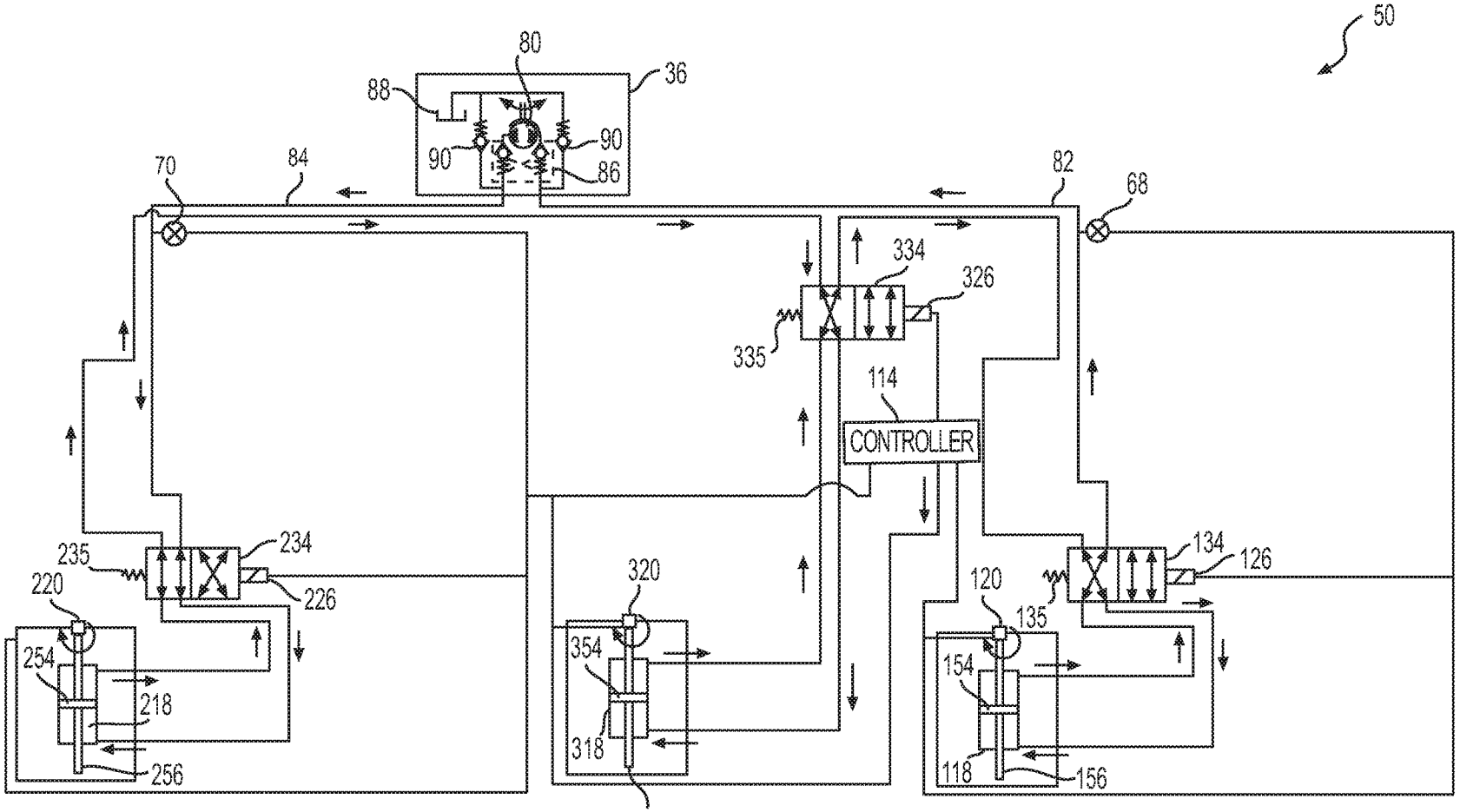
FIG. 8 is a schematic view of a hydraulic steering system of the watercraft of FIG. 1 having three outboard motors.

In an alternative implementation, with reference to FIG. 8, the watercraft 10 has the additional outboard motor 300 which occupies a central position between the outboard motors 100, 200. As shown in FIG. 8, in this alternative implementation, the steering system 50 includes a steering position sensor 320 for sensing the steering position of the outboard motor 300, a hydraulic steering actuator 318 for steering the outboard motor 300, and a direction valve 334 for reversing a direction of flow of hydraulic fluid into the hydraulic steering actuator 318. Hydraulic fluid is pumped by the pump 80 of the hydraulic helm 36 to one of port and starboard steering actuators 118, 218, then to the central steering actuator 318, and then to the other of the port and starboard steering actuators 118, 218. In the example illustrated in FIG. 8, the hydraulic helm 26 is being actively steered toward port such that hydraulic fluid is pumped from the pump 80 of the hydraulic helm 36 to the steering actuator 218, then to the steering actuator 318, and then to the steering actuator 118. The steering position of the central outboard motor 300 is defined by a steering angle $\theta_c$ formed between its thrust axis and a neutral reference axis that correspond to the position of the thrust axis of the outboard motor 300 when the watercraft 10 is set to drive in a straight line. In this alternative implementation, the realignment process includes comparing the steering angles $\theta_{st}$, $\theta_{po}$, $\theta_c$ to determine different steering angle differences, including: $\Delta\theta_1=\theta_{st}-\theta_{po}$, $\Delta\theta_2=\theta_c-\theta_{st}$, $\Delta\theta_3=\theta_{po}-\theta_c$ and verifying if each of the steering angle differences $\Delta\theta_1$, $\Delta\theta_2$, $\Delta\theta_3$ is greater than the predetermined steering angle difference threshold $\theta_{th}$. In this implementation, only the largest of the steering angle differences $\Delta\theta_1$, $\Delta\theta_2$, $\Delta\theta_3$ is corrected such that a single one of the outboard motors 100, 200, 300 is realigned. For instance, in this example, assuming that the steering angle difference $\Delta\theta_2$ is the largest of the steering angle differences (i.e., the difference between the steering angle $\theta_c$ and the steering angles $\theta_{st}$ is greatest) and is above the predetermined steering angle threshold $\theta_{th}$, the steering controller 114 is configured to determine which of the outboard motors 100, 300 to realign in the same manner described above with respect to realigning the outboard motors 100, 200. Notably, the realignment process would determine which of the starboard and central outboard motors 100, 300 to realign in the same manner that was determined for realigning the starboard and port outboard motors 200 respectively (i.e., in this case, the central outboard motor 300 would be "treated" as the port outboard motor 200 was in the realignment process described above while the starboard outboard motor 100 would be still be treated as it was in the realignment process described above). The realignment process may alternatively align more than one of the outboard motors 100, 200, 300. For example, the steering controller 114 may align one of the outboard motors 100, 300 first and then one of the outboard motors 200, 300.

In other examples, the realignment process for realigning the outboard motors 100, 200, 300 may evaluate different pairings of the outboard motors 100, 200, 300 for realignment. For instance, only the steering angle difference $\Delta\theta_1$ and one of the steering angle differences $\Delta\theta_2$, $\Delta\theta_3$ may be evaluated and misalignment determined and corrected in the same manner as described above with respect to the realignment of the outboard motors 100, 200. Notably, for each pairing of the outboard motors motors 100, 200, 300, the selection of which outboard motors 100, 200, 300 to realign is done in the manner described above with respect to the realignment of the outboard motors 100, 200 (with the portmost outboard motor being treated as the port outboard motor 200 was above, and the starboardmost outboard motor being treated as the startboard outboard motor 100 was above).

As another example, the realignment process for realigning the outboard motors 100, 200, 300 may only evaluate the steering angle differences $\Delta\theta_2$, $\Delta\theta_3$ and misalignment determined and corrected in the same manner as described above with respect to the realignment of the outboard motors 100, 200.

It is contemplated that the steering controller 114 could simultaneously realign more than one of the outboard motors 100, 200, 300 to reduce the misalignment between the outboard motors 100, 200, 300.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A steering system for a watercraft having first and second outboard motors, the steering system comprising:
- a first steering position sensor for sensing a steering position of the first outboard motor;
- a second steering position sensor for sensing a steering position of the second outboard motor;
- a first hydraulic steering actuator for steering the first outboard motor;
- a second hydraulic steering actuator for steering the second outboard motor, the second hydraulic steering actuator being hydraulically linked to the first hydraulic steering actuator;
- a hydraulic helm selectively supplying hydraulic fluid to the first and second hydraulic steering actuators in accordance with an active steering direction selected by an operator of the watercraft;
- at least one valve for reversing a direction of flow of hydraulic fluid into the first and second hydraulic steering actuators; and
- a steering controller in communication with the first and second steering position sensors and the at least one valve, the steering controller being configured to execute a realignment process including:
  - receiving signals indicative of the steering positions of the first and second outboard motors from the first and second steering position sensors;
  - based at least in part on the signals from the first and second steering position sensors, determining if the first outboard motor and the second outboard motor are misaligned; and
  - if the first outboard motor and the second outboard motor are determined to be misaligned, actuating the at least one valve in order to direct the flow of hydraulic fluid into a corresponding one of the first and second hydraulic steering actuators in a direction opposite to that corresponding to the active steering direction set by the hydraulic helm so as to reduce misalignment of the first and second outboard motors.

2. The steering system of claim 1, wherein the at least one valve includes a first valve and a second valve,
- the first valve being configured for reversing the direction of flow of hydraulic fluid into the first hydraulic steering actuator,
- the second valve being configured for reversing the direction of flow of hydraulic fluid into the second hydraulic steering actuator.

3. The steering system of claim 2, wherein said actuating the at least one valve comprises actuating only a selected one of the first and second valves.

4. The steering system of claim 3, wherein:
- the first outboard motor has a first thrust axis;
- the second outboard motor has a second thrust axis;
- when the first and second outboard motors are misaligned such that the first and second thrust axes converge toward one another rearwardly, actuating the selected one of the first and second valves is operable to cause the corresponding one of the first and second hydraulic steering actuators to steer a corresponding one of the first and second outboard motors such as to reduce convergence of the first and second thrust axes; and
- when the first and second outboard motors are misaligned such that the first and second thrust axes diverge from one another rearwardly, actuating the selected one of the first and second valves is operable to cause the corresponding one of the first and second hydraulic steering actuators to steer a corresponding one of the first and second outboard motors such as to reduce divergence of the first and second thrust axes.

5. The steering system of claim 4, wherein:

the first outboard motor is a port outboard motor and the second outboard motor is a starboard outboard motor;

the first thrust axis is a port thrust axis and the second thrust axis is a starboard thrust axis;

the first valve is a port valve and the second valve is a starboard valve;

the first hydraulic steering actuator is a port hydraulic steering actuator and the second hydraulic steering actuator is a starboard hydraulic steering actuator;

when the hydraulic helm is being actively steered such as to change a current course of the watercraft and the active steering direction set by the hydraulic helm is starboard, the selected one of the port and starboard valves is:

the port valve when the port and starboard outboard motors are misaligned such that the port and starboard thrust axes converge toward one another rearwardly, such that actuating the port valve reduces convergence of the port and starboard thrust axes;

the starboard valve when the port and starboard outboard motors are misaligned such that the port and starboard thrust axes diverge from one another rearwardly, such that actuating the starboard valve reduces divergence of the port and starboard thrust axes;

and when the hydraulic helm is being actively steered such as to change a current course of the watercraft and the active steering direction set by the hydraulic helm is port, the selected one of the port and starboard valves is:

the starboard valve when the port and starboard outboard motors are misaligned such that the port and starboard thrust axes converge toward one another rearwardly, such that actuating the starboard valve reduces convergence of the port and starboard thrust axes;

the port valve when the port and starboard outboard motors are misaligned such that the port and starboard thrust axes diverge from one another rearwardly, such that actuating the port valve reduces divergence of the port and starboard thrust axes.

6. The steering system of claim 1, wherein:

the hydraulic helm is hydraulically connected to the first hydraulic steering actuator;

the first hydraulic steering actuator is hydraulically connected to the second hydraulic steering actuator;

the second hydraulic steering actuator is hydraulically connected to the hydraulic helm; and the at least one valve is hydraulically connected between at least one of the first and second hydraulic steering actuators and the hydraulic helm.

7. The steering system of claim 1, further comprising a steering operation detector for detecting a steering parameter of the hydraulic helm, the steering controller being in communication with the steering operation detector, wherein the realignment process includes:

receiving the steering parameter of the hydraulic helm from the steering operation detector; and based on the steering parameter, determining if the hydraulic helm is in an active steering state in which the hydraulic helm is being operated to actively steer the watercraft such as to change a current course of the watercraft, said actuating of the at least one valve being carried out only if the hydraulic helm is determined to be in the active steering state.

8. The steering system of claim 7, wherein:

the hydraulic helm has a first hydraulic connection to the first hydraulic steering actuator and a second hydraulic connection to the second hydraulic steering actuator; and the steering parameter detected by the steering operation detector is a pressure difference between a pressure in the first hydraulic connection and a pressure in the second hydraulic connection.

9. The steering system of claim 8, wherein the steering operation detector comprises a first hydraulic pressure sensor for sensing the pressure in the first hydraulic connection and a second hydraulic pressure sensor for sensing the pressure in the second hydraulic connection.

10. The steering system of claim 8, wherein the steering controller determines that the watercraft is in the active steering state when the pressure difference is greater than a predetermined pressure difference threshold.

11. The steering system of claim 7, wherein the steering controller is configured to end the realignment process at any time that the hydraulic helm is no longer in the active steering state.

12. The steering system of claim 1, wherein:

the first steering position sensor senses a steering angle of the first outboard motor;

the second steering position sensor senses a steering angle of the second outboard motor;

the steering position of the first outboard motor being defined by the steering angle of the first outboard motor, and the steering position of the second outboard motor being defined by the steering angle of the second outboard motor; and the steering controller determines that the first outboard motor and the second outboard motor are misaligned when a steering angle difference between the steering angle of the first outboard motor and the steering angle of the second outboard motor is greater than a first predetermined angle difference threshold.

13. The steering system of claim 12, wherein the steering controller maintains the at least one valve open until the steering angle difference is below a second predetermined angle difference threshold that is less than the first predetermined angle difference threshold.

14. The steering system of claim 1, wherein the steering controller is configured to end the realignment process after a predetermined time period of having started the actuation of the at least one valve.

15. The steering system of claim 14, wherein the predetermined time period is less than 1 second.

16. The steering system of claim 15, wherein the predetermined time period is less than or equal to 0.3 seconds.

17. The steering system of claim 14, wherein, after ending the realignment process, the steering controller reinitiates the realignment process when the steering controller determines that the watercraft is being actively steered in a direction opposite to the active steering direction selected by the operator prior to aborting the realignment process.

18. A steering system for a watercraft having a plurality of outboard motors, the steering system comprising:

a plurality of steering position sensors for sensing a steering position of the plurality of outboard motors;

a plurality of hydraulic steering actuators for steering the plurality of outboard motors;

a hydraulic helm selectively supplying hydraulic fluid to the plurality of hydraulic steering actuators in accordance with an active steering direction selected by an operator of the watercraft;

a plurality of valves for reversing a direction of flow of hydraulic fluid into the plurality of hydraulic steering actuators; and a steering controller in communication with the plurality of steering position sensors and the plurality of valves, the steering controller being configured to execute a realignment process including:

receiving signals indicative of the steering positions of the plurality of outboard motors from the plurality of steering position sensors;

based at least in part on the signals from the plurality of steering position sensors, determining if the plurality of outboard motors are misaligned; and if the plurality of outboard motors are determined to be misaligned, actuating at least one of the plurality of valves in order to direct the flow of hydraulic fluid into a selected one of the plurality of hydraulic steering actuators in a direction opposite to that corresponding to the active steering direction set by the hydraulic helm so as to reduce misalignment of the plurality of outboard motors.

19. The steering system of claim 18, wherein:

each of the plurality of steering position sensors senses a steering angle of an associated one of the plurality of outboard motors;

the steering positions of the plurality of outboard motors are defined by the steering angles of the plurality of outboard motors;

the steering controller determines that the plurality of outboard motors are misaligned when a steering angle difference between a steering angle of a first outboard motor of the plurality of outboard motors and a steering angle of a second outboard motor of the plurality of outboard motors is greater than a predetermined angle difference threshold.

20. A method of aligning first and second outboard motors of a watercraft, the first and second outboard motors being hydraulically linked, the method comprising:

comparing a steering position of the first outboard motor to a steering position of the second outboard motor;

based on said comparing, determining if the first outboard motor and the second outboard motor are misaligned;

if the first outboard motor and the second outboard motor are determined to be misaligned, actuating a valve in order to direct flow of hydraulic fluid into a hydraulic steering actuator of one of the first and second outboard motors in a direction opposite to that corresponding to an active steering direction set by a hydraulic helm of the watercraft so as to reduce misalignment of the first and second outboard motors.

* * * * *